United States Patent [19]

Birkett

[11] 4,258,621

[45] Mar. 31, 1981

[54] ROTATING OBJECT IMPRINTING DEVICE WITH RELATIVELY SLIDING PLATE

[76] Inventor: Earl Birkett, c/o Birkett Automation Industries, Ltd., 91 E. Fulton Ave., Roosevelt, N.Y. 11575

[21] Appl. No.: 44,178

[22] Filed: May 31, 1979

[51] Int. Cl.[3] ..... B41F 17/20

[52] U.S. Cl. ..... 101/40; 101/7; 101/39

[58] Field of Search ..... 101/5, 7, 8, 38 R, 38 A, 101/39, 40

[56] References Cited

U.S. PATENT DOCUMENTS

| | | | |
|---|---|---|---|
| 2,703,047 | 3/1955 | Scherer et al. | 101/8 |
| 3,608,480 | 9/1971 | Sciame | 101/7 |
| 3,640,213 | 2/1972 | Schwartzbach | 101/8 |
| 3,783,776 | 1/1974 | Noble et al. | 101/40 X |

*Primary Examiner*—Edward M. Coven

*Attorney, Agent, or Firm*—Bauer & Amer

[57] ABSTRACT

In the use of pigment coated foil, e.g. so-called "gold leaf" being a common example, in the imprinting of pens, there is unavoidable slippage between the pen, supported on one or more idler rollers, and a rotationally driven printing slug, which detracts from the clarity of the imprinting indicia. This is obviated herein by using a stationary heated printing slug and converting a pen-supporting roller from an idler into a driving roller to, in turn, cause corresponding rotation in the pen. The pen is thus caused to rotate or "roll" across or along the printing slug, and such movement in turn causes the gold leaf to transfer onto the pen with a high degree of clarity.

1 Claim, 10 Drawing Figures

ROTATING OBJECT IMPRINTING DEVICE WITH RELATIVELY SLIDING PLATE

The present invention relates generally to imprinting devices for pens or other similar cylindrical objects, and more particularly to an improved imprinting operational mode for such devices, particularly those using coated foil or leaf, which significantly contributes to the clarity of the indicia transferred from the coated strip onto the pen.

As exemplified by U.S. Pat. No. 2,461,233, a pen or other cylindrical object is typically prepared for imprinting by being supported on an idler roller, or even in the space between two adjacent idler rollers. The printing slug, mounted on a pivotally traversable or rotatable drum, is then moved into and through printing contact with the pen, wherein rotation of the pen, as permitted by the idler roller supports for same, presents the pen surface area for imprinting. However, no matter how effective the bearings are of the idler roller supports for the pen, there is unavoidable drag or resistance against rotation exerted on the pen by these rollers. The surface speed of the pen being imprinted and that of the printing slug are therefore often not substantially identical, with the result that the clarity of the transferred indicia is marred by double impressions, blurring, and other such defects.

Broadly, it is an object of the present invention to provide an improved imprinting device for a pen or other such cylindrical object, overcoming the foregoing and other shortcomings of the prior art. More particularly, using to advantage the cylindrical shape of the object to be imprinted or decorated, and thus its ability to "roll", it is an object to drive or power said object in rotation during its printing contact with the printing slug, such that there is little or no likelihood that the same letters or numbers of the imprinting slug can contact, and thus print on, successively encountered areas of the pen.

An imprinting device for pens or the like demonstrating objects and advantages of the present invention includes a slide operatively arranged for movement from a clearance position past a printing station, said slide having a cylindrical object-receiving slot with a bottom opening therein. An object-supporting roller is journalled for rotation in said slot bottom opening. Defining said printing station are a cooperating imprinting means and roller rotation-imparting means in spaced apart facing relation to each other, said roller rotation-imparting means being effective by raising a superposed arrangement of a cylindrical object and said roller so as to cause a jamming of the object in printing contact against the imprinting means. This jamming also effectively converts the roller from an idler to a driving roller such that there is driving rotation in said roller and corresponding driven rotation in said cylindrical object during the movement of the slide past the printing station. The result of the driven rotation of the object along the imprinting means is that it contributes to the imprinting thereof with a significant extent of clarity.

The above brief description, as well as further objects, features and advantages of the present invention, will be more fully appreciated by reference to the following detailed description of a presently preferred, but nonetheless illustrative embodiment in accordance with the present invention, when taken in conjunction with the accompanying drawings, wherein:

FIG. 1 is a perspective view of a typical prior art imprinting device having an imprinting surface which partakes of a pivotal or rotational traverse in relation to the object being imprinted;

FIG. 2 is a detailed perspective view illustrating the unavoidable slippage which results during operation of the prior art imprinting device of FIG. 1;

Figure 3:
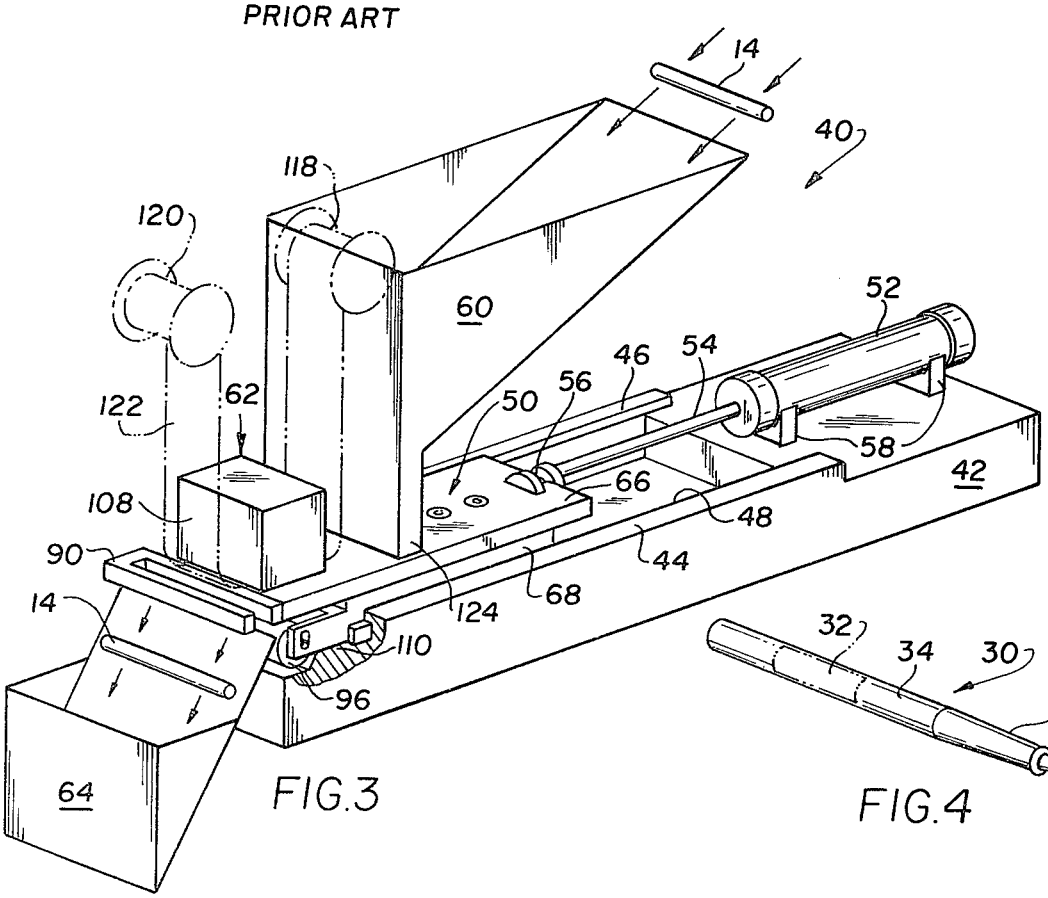
Figure 4:
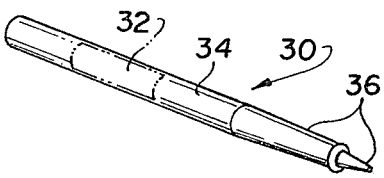
Figure 5:
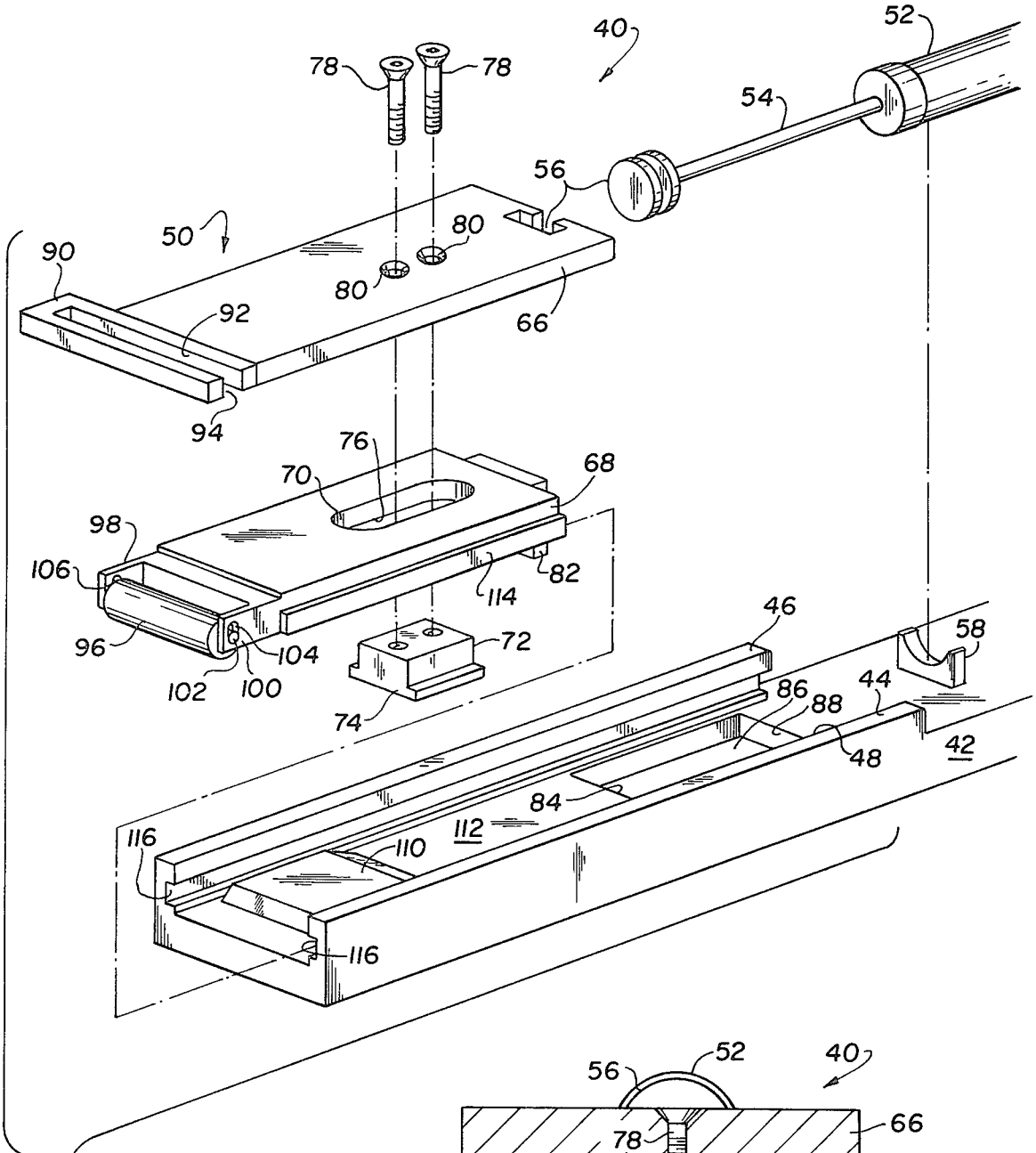
Figure 6:
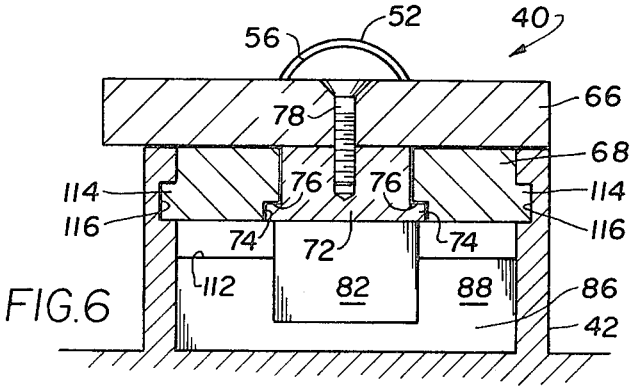
Figure 7A:
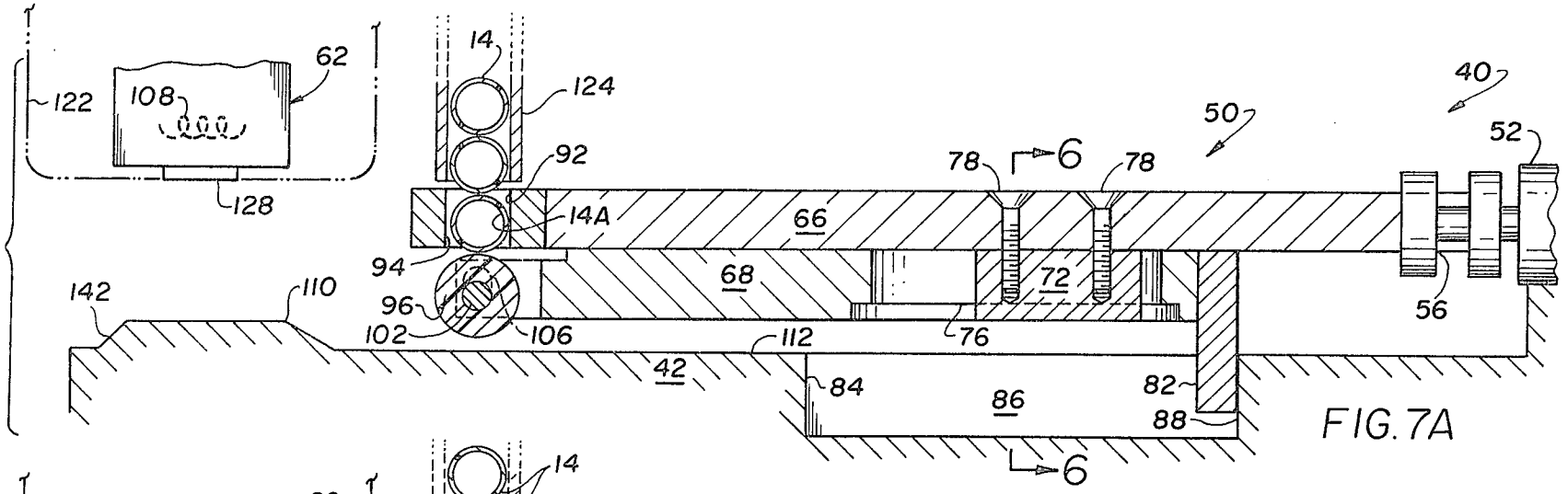
Figure 7B:
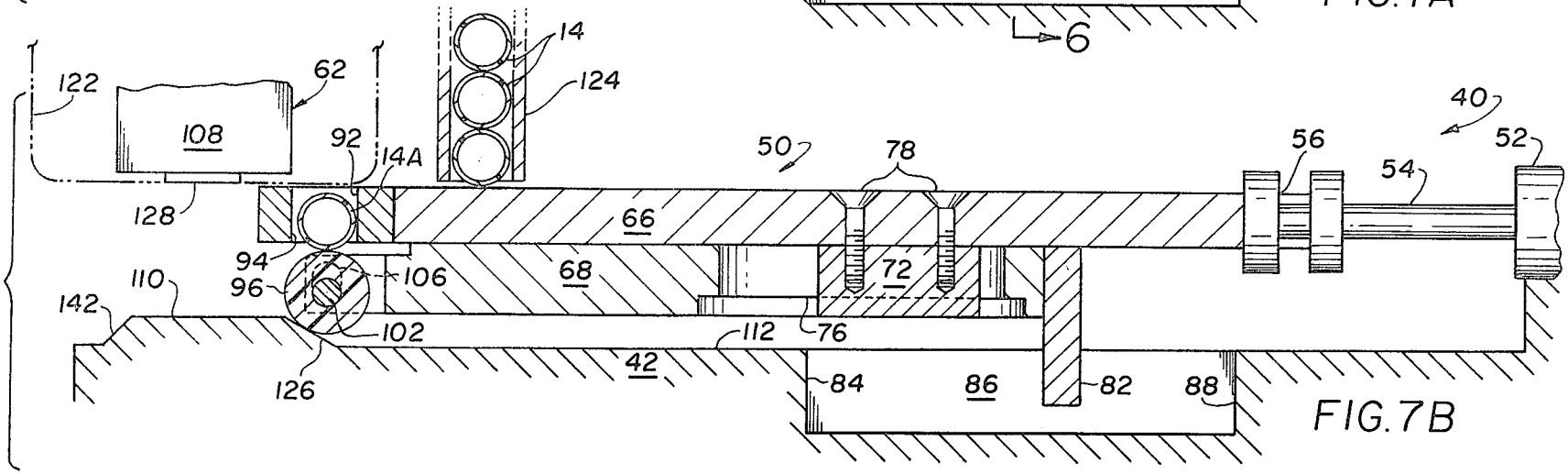
Figure 7C:
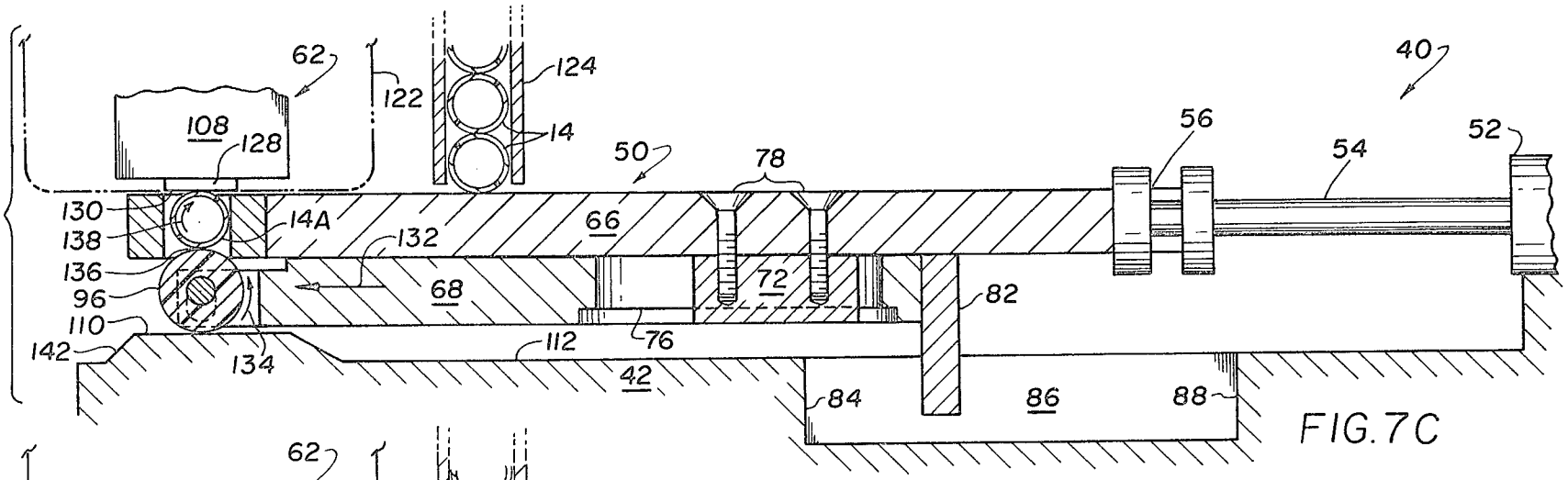

Remaining FIGS. 3–6 and sequential views FIGS. 7A–7D, illustrate the preferred embodiment of the within improved imprinting device. More particularly, FIG. 3 is a perspective view of the device, with portions broken away to better illustrate the details thereof;

FIG. 4 is a perspective view of a typical imprinted product, such as a pen, in which a significant area thereon is imprinted as illustrated in phantom perspective;

FIG. 5 is an exploded perspective view illustrating the assembly of the slide of the within device and how such component is mounted for sliding movement;

FIG. 6 is a side elevational view in section taken on line 6—6 of subsequent side elevational view FIG. 7A;

Remaining FIGS. 7A–7D are side elevational views illustrating the imprinting device hereof at successive stages of movement during the imprinting of a pen or the like. More particularly, FIG. 7A illustrates such pen in a slide used to transport the same at an initial clearance position from the printing station of the within device;

FIG. 7B illustrates the transported pen as it enters into said printing station;

FIG. 7C illustrates the pen as it is actually being imprinted; and

Figure 7D:
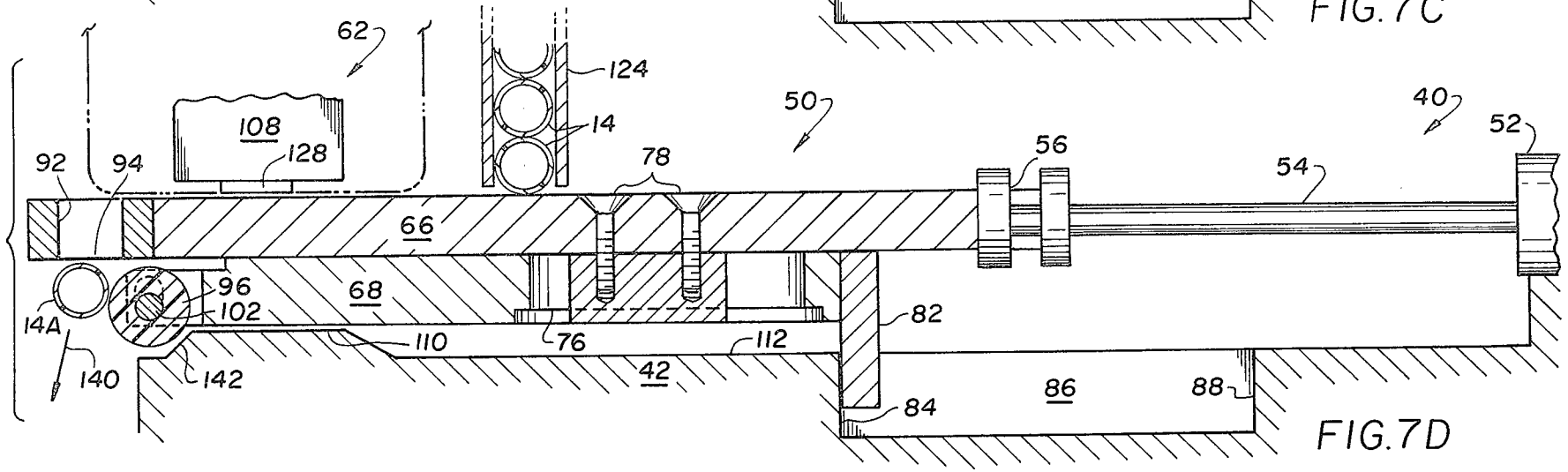

FIG. 7D illustrates the within device after imprinting of the pen and as it is being discharged from the device.

Figure 1:
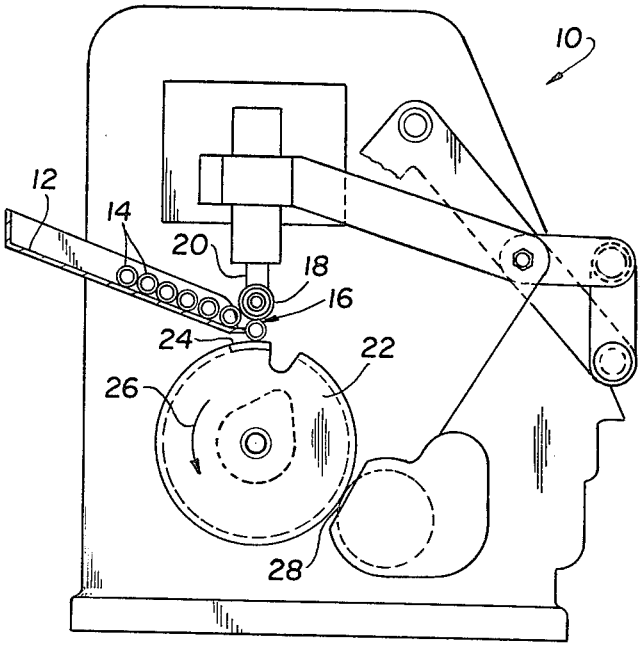
FIG.1 PRIOR ART
FIGS. 1 and 2 illustrate the prior art. More particularly.
Figure 2:
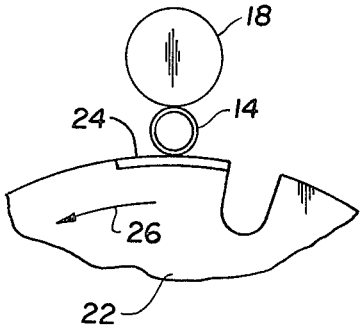
FIG.2 PRIOR ART

Before proceeding with a detailed description of the improved imprinting device hereof as illustrated starting in FIG. 3, it is helpful to first generally note the construction and mode of operation of a typical prior art imprinting device as shown in FIGS. 1, 2. For present purposes it suffices to note that such prior art device 10 includes a hopper 12 arranged to gravity feed a plurality of cylindrical objects 14, which could be the cylindrical barrels of pens, to a printing station 16. Station 16 includes a roller 18 journalled for rotation on the depending end of a link member 20 which is appropriately arranged for vertical reciprocating movement towards and away from the rotationally driven imprinting roller 22. Thus, and as is well understood, in the operation of device 10 the pen barrels 14 are allowed to move one at a time into the printing station 16 in which each is held by the idler roller 18 in contact against the imprinting surface of roller 22.

As is perhaps best illustrated in FIG. 2, a printing slug 24 is embodied in the surface of roller 22 so that rotative movement 26 carries the imprinting surface of slug 24, which has been previously inked by inking roller 28, into imprinting contact with the pen barrel 14. What is significant in the illustration of FIG. 2 is that no matter how effective the bearings are in the mounting of the idler or support roller 18, there is unavoidable drag exerted on the pen barrel 14 which thus prevents the surface of the barrel from moving at the exact surface speed as the surface speed of the imprinting roller 22. As a result of this differential in the movement of the imprinting surface, namely surface 24, and the surface being imprinted, namely the surface of the pen barrel 14, there is an unavoidable lack of clarity in the letters or other indicia that are transferred from the one to the other.

In accordance with the present invention, the pen or cylindrical object surface being imprinted is moved across a stationary imprinting surface in such manner, as will be described in detail subsequently, that there is no slippage therebetween or differential movement as just described, with the result that there is significant clarity in the indicia that is imprinted on the pen. As illustrated in FIG. 4, for example, a pen 30 imprinted with the improved device hereof will have a significant area 32 thereof, which may consist of two or three lines of letters and numbers, gold stamped on its cylindrical barrel 34 by the within imprinting device. After the imprinting, the barrel 34 is then assembled with the printing component, generally designated 36, in a well understood manner to complete the pen 30. As already noted, the crux of the within invention is the manner in which the imprinting device enables the gold stamping of the area 32 with an unusual and characterizing extent of clarity.

As is perhaps best illustrated in FIGS. 3, 5 and 6, structurewise the improved imprinting device hereof, generally designated 40, includes a base 42 having upstanding opposite side walls 44 and 46 which define a channel or slideway 48 therebetween. Slidably disposed in channel 48 is a two-part slide construction 50, the structural details of which will soon be described, which construction 50 is reciprocated back and forth along the channel 48 by a pressure air cylinder 52 having a reciprocating piston 54 attached to the slide construction 50, as at 56.

More particularly, the operative arrangement is one in which the pressure air cylinder 52 is appropriately supported on a cradle 58 rearwardly of the base 42 and is operatively arranged during its power stroke, which is from right to left as viewed in FIGS. 3, 5, to urge the slide construction 50 from an initial pen-receiving position beneath the discharge end of hopper 60 past an imprinting station, generally designated 62, and into a terminating position extended slightly beyond, as illustrated in FIG. 3, in which each finished pen barrel 14, previously imprinted at the station 62, is automatically discharged into a hopper or bin 64.

For a better understanding of the detailed structural features of the slide construction 50, reference should be made to FIG. 5. As illustrated therein, construction 50, in a preferred embodiment, consists of an upper slide plate 66 and a lower slide plate 68, the two plates being connected to each other to form a unitary structure, but at the same time allowing for sliding movement of the upper plate 66 relative to the lower plate 68. To allow for the just-referred to sliding movement, lower plate 68 is machined or otherwise appropriately provided with a central slot 70 through which is projected a T-shaped block 72, the horizontally oriented leg 74 of which, as clearly illustrated in FIG. 6, extends into accommodating shoulders 76 machined in the bottom surface of plate 68. Completing the clamp function for the block 72 are a pair of flathead Allen screws or similar connecting members 78 which are projected through openings 80 in upper plate 66 into threaded engagement with block 72. Thus, block 72, or more particularly the laterally extending leg 74 thereof, is effective in attaching the two plates 66 and 68 together and, to the extent that slot 70 is larger than block 72, there is clearance for sliding movement of upper slide plate 66 relative to lower slide plate 68. Such sliding movement and the significance thereof, which will soon be apparent as the description proceeds, is provided by the attachment of the pressure air cylinder piston 54 to an overhanging rear portion of the upper slide plate 66 so that it is actually only this slide plate which is under the urgency of the pressure air cylinder 52. On lower slide plate 68 there is a depending block 82 which in the power stroke of the slide construction 50, which, as already noted, is from right to left, abuts against the front wall 84 of a recess 86 in which the depending projection is disposed. As a consequence of the abutment of block 82 against wall 84, the lower slide member or plate 68 is held stationary while the upper plate 66 under the urgency of the powering force of the air pressure cylinder 52 continues its sliding movement in the slideway 48 and thus moves in sliding movement relative to the lower plate 68. At this point in the description it is convenient to note that on the return stroke, also powered by the air cylinder 52, abutment of the depending block 82 against the rear wall 88 of recess 86 again is effective in holding the lower slide member 68 against movement while upper slide member 66 is urged by its operative connection to the air cylinder 52 through sliding movement relative thereto. Such sliding movement again restores the two plates 66 and 68 into a desired vertical alignment or relation with each other, as will now be described.

In a preferred embodiment, top plate 66 is attached to a component 90, by welding or any other appropriate manner, and such component has appropriately machined therein a slot 92 that is slightly oversized in relation to the pen barrel 14 to be imprinted. An important feature of slot 92 is that the side walls bounding the same have a bottom opening 94. Cooperating with the bottom opening 94, in a manner which will soon be described in detail, is an elastomeric covered roller 96 that is journalled for rotation on a pair of bifurcated arms 98 and 100 extending forwardly of the bottom slide 68. Axle pin 102 which extends centrally of the roller 96 extends into oversized slots 104 and 106 in the arms 98, 100, the oversize of said slots being in a vertical orientation such that the roller 96 is capable of being raised and lowered to the extent of clearance that exists between the slots 104 and 106 and the diameter of the axle pin 102. In the starting operative position of the slide construction 50, roller 96 is directly beneath and may even extend partially into the bottom opening 94 of slot 92, and thus cooperates with slot 92 to form an open compartment into which each of the pen barrels 14 to be imprinted is received preparatory to being carried during the power stroke of the slide construction 50 to the printing station 62.

In connection with printing station 62, reference to FIGS. 3 and 5 will indicate that such station is defined by a heating element 108 which will be understood to be appropriately mounted in an elevated and facing relation to a ramp 110 (see FIG. 5 in particular) that is fixedly mounted in the path of sliding movement of the slide construction 50 on surface 112 of the channel or slideway 48. At this point in the description it is also convenient to note that laterally extending guides on opposite sides of the bottom plate 68, denoted by the reference numeral 114, are adapted to project into cooperating guideways 116 machined or otherwise appropriately provided in the side walls 44, 46.

Completing the printing station 62 is structure appropriately mounting a cooperating supply spool 118 and wind-up spool 120 for an imprinting medium 122, which may be a strip of low-temperature gold leaf or the like.

The significance of the construction of the improved imprinting device 10 hereof as just described can best be appreciated by considering the contemplated mode of operation as illustrated by sequential views 7A–7D, to which reference is now made. More particularly, FIG. 7A illustrates the slide construction 50 at its initial position of movement in which the aligned relation between the top slide 66 and bottom slide 68 is one which strategically locates the roller 96 in alignment with the bottom opening 94 of slot 92. As a result, pen barrels 14, in a desired superposed relation, drop through an exit chute 124 of hopper 60 such that the bottom pen barrel, specifically designated 14A, enters fully into the slot 92 and is supported on the roller 96.

Next, and as is illustrated in FIG. 7B, pressure air cylinder 52 is operated so that its piston rod 54 partakes of its power stroke and urges the slide construction 50 from beneath chute 124 towards the printing station 62, a direction which is from right to left as viewed in FIG. 7B. The significant result of this movement is that the roller 96 establishes contact with the slightly angularly inclined leading edge 126 of ramp 110. This, of course, causes roller 96 to be raised to the extent permitted by the clearance between pin 102 and the oversized slots 104, 106. At the position of movement depicted in FIG. 7B, pen barrel 14A is situated slightly in advance of the printing slug 128 which will be understood to be appropriately operatively associated with heating element 108 and the length of gold leaf 122 threaded beneath the printing slug 128. As further understood, heating element 108 elevates the temperature of the printing indicia of the slug 128, which typically are letters and numbers, so that such indicia when contacting the gold leaf 122 is effective in melting the gold leaf off of a backing strip in a letter or number shape, as the case may be. As further understood, the gold leaf released as just described from the backing strip, deposits itself on the surface presented for imprinting, in this instance being the cylindrical surface of the pen barrel 14A, and thus manifests itself as "gold" printing on the pen barrel.

While the imprinting process as above generally described is well known, heretofore it was not known how to effectuate the transfer of the letter and number-shaped gold leaf from the backing strip 122 onto the pen barrel surface 14A with a high degree of clarity. In accordance with the present invention a characterizing high degree of clarity is achieved by the within device 40, and this is due significantly to the conditions prevailing during the printing operation of the device 40, as more particularly depicted in FIG. 7C.

The operative condition of the various components as depicted in FIG. 7C is one in which the power stroke of the slide construction 50 provides roller 96 with a surmounted relation or position upon the flat horizontally oriented surface of ramp 110. The distance between ramp surface 110 and the imprinting surface 130 of slug 128 in facing relation therewith is selected to be slightly less than the two superposed diameters of roller 96 and pen barrel 14A. As a result, roller 96 and pen barrel 14A are jammed between the surfaces 110 and 130. With the understanding that surface 110 is slightly roughened in any appropriate manner so as to constitute a friction surface, the consequence of the aforesaid jamming is that continued sliding movement 132 of the slide construction 50 under the powering influence of the pressure cylinder 52 causes counterclockwise rotation 134 in roller 96. Stated another way, the frictional engagement between the surface of roller 96 and friction surface 110 is such as to convert this roller from an initial idler condition to a driving roller condition. Thus, at the bight 136 between roller 96 and the pen barrel 14A, there is effectively transmitted a rotational force on the pen barrel 14A which drives it in clockwise rotation 138. As a result of this directional rotation, the cylindrical surface of pen barrel 14A "rolls across" the imprinting surface 130 of printing slug 128 and, most significant, there is no "slippage" therebetween as might adversely affect the clarity of the indicia which is imprinted on the pen barrel 14A. By "slippage" is meant contact with the same indicia of successively encountered areas of the object being imprinted, such that there is an undesirable double impression of the imprinted indicia reproduced in these successively encountered areas.

In the next position of movement of the operating components of device 40 as depicted in FIG. 7D, the imprinted pen barrel 14A is released from the slot or compartment 92 of upper slide 66 and falls, as in the direction 140, into previously noted collection bin 64. Release of the imprinted pen barrel 14A results when depending member 82 of the lower slide 68 abuts against the stop or wall 84 of recess 86 and thus prevents further movement of the lower slide 68. Meanwhile, pressure air cylinder 52 continues to urge upper slide 66 through sliding movement to the left, which has the result of projecting the slot 92 with the imprinted pen barrel 14A therein beyond roller 96, a condition illustrated in FIG. 7D. Once roller 96 is cleared, the imprinted pen barrel 14A is free to fall out of the bottom opening 94 of slot 92 and, of course, does so, falling into the collection bin or hopper 64. To facilitate release of the imprinted pen barrel 14A ramp construction 110 has an angularly inclined trailing edge 142.

Pressure air is then delivered into the pressure cylinder 52 in such manner as to cause retraction of the piston rod 54, and thus the return of the slide construction 50 to its starting condition as illustrated in FIG. 7A. When returning to such starting position, depending projection 82 abuts against the recess rear wall 88 and thus holds the lower slide 68 against movement while the pressure cylinder 52 restores slot 92 of the upper slide plate 66 to its aligned relation above roller 96. The improved imprinting device 40 hereof is then in condition for further cyclic operation.

Although the improved imprinting device 40 hereof is particularly suitable for imprinting pen barrels, it can also be effectively used for imprinting or otherwise decorating other cylindrical objects such as lipstick tubes, and even the cylindrical tops of aerosol cans or the like. Thus, in the aforesaid and other respects, a latitude of modification, change and substitution is intended in the foregoing disclosure, and in some instances some features of the invention will be employed without a corresponding use of other features. Accordingly, it is appropriate that the appended claims be construed broadly and in a manner consistent with the spirit and scope of the invention herein.

What is claimed is:

1. An imprinting device for pens and similar cylindrical objects comprising superposed top and bottom plate members operatively arranged for movement along a movement path from a clearance position past a printing station, said superposed top and bottom plate members being so connected to each other as to allow selected sliding movement of said top plate member relative to said bottom slide member, said top plate member having a cylindrical object-receiving slot with a bottom opening therein, a roller journalled for rotation on said bottom plate member and extending into said slot bottom opening of said top plate member, and at said printing station a cooperating imprinting means and roller rotation-imparting means in spaced apart facing relation to each other, said roller rotation-imparting means being a ramp disposed at said printing station in said movement path of said superposed plate members and effective to cause the raising of said roller and cylindrical object into printing contact with said imprinting means such that there is driving rotation in said roller and corresponding driven rotation in said cylindrical object during said movement of said superposed plate members past said printing station, and stop means on said bottom plate member effective to hold said bottom plate member against movement and to allow said continued sliding movement of said top plate member preparatory to discharging an imprinted object from the end of said top plate member extending beyond said bottom plate member.

* * * * *